US006494695B1

(12) United States Patent
Lifson

(10) Patent No.: US 6,494,695 B1
(45) Date of Patent: Dec. 17, 2002

(54) ORBITING SCROLL CENTER OF MASS OPTIMIZATION

(75) Inventor: Alexander Lifson, Manlius, NY (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/663,981

(22) Filed: Sep. 19, 2000

(51) Int. Cl.[7] ..... F03C 2/00
(52) U.S. Cl. ..... 418/55.2; 418/151; 418/1
(58) Field of Search ..... 418/55.2, 151, 418/1

(56) References Cited

U.S. PATENT DOCUMENTS

| | | | | | |
|---|---|---|---|---|---|
| 4,457,674 | A | * | 7/1984 | Kawano et al. | 418/55.2 |
| 4,690,625 | A | * | 9/1987 | Murayama et al. | 418/55.2 |
| 5,127,809 | A | * | 7/1992 | Amata et al. | 418/55.2 |

FOREIGN PATENT DOCUMENTS

| | | | | |
|---|---|---|---|---|
| JP | 58-110886 | * | 7/1983 | 418/55.2 |
| JP | 59-119081 | * | 7/1984 | 418/55.2 |
| JP | 60-145474 | * | 7/1985 | 418/55.2 |
| JP | 60-233388 | * | 11/1985 | 418/55.2 |
| JP | 62-105293 | * | 5/1988 | 418/55.2 |
| JP | 64-003201 | * | 1/1989 | 418/55.2 |
| JP | 04-094485 | * | 3/1992 | 418/55.2 |

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

The location of center of mass of an orbiting scroll is optimized by adding or removing mass at certain strategic locations on the orbiting scroll member. The center of mass is optimized to reduce alternating torsional moment acting on Oldham coupling. Reduction in alternating torsional moment minimizes unwanted radiated sound caused by Oldham coupling chatter.

3 Claims, 6 Drawing Sheets

ORBITING SCROLL CENTER OF MASS OPTIMIZATION

BACKGROUND OF THE INVENTION

This invention optimizes the location of a center of mass of an orbiting scroll, by adding or removing material at certain strategic locations on the orbiting scroll.

Scroll compressors are widely applied in refrigerant compression applications. In a scroll compressor, a pair of scroll members each have a base with a spiral wrap extending from the base. The wraps of the two scroll members interfit to define compression chambers. A shaft drives one of the scroll members to orbit relative to the other.

Scroll compressors are provided with counterweights mounted on the shaft to counteract vibration that would otherwise occur, mainly due to mass imbalance caused by orbiting motion of the orbiting scroll.

While overall compressor vibration is minimized by proper selection and location of shaft counterweights, there can be an alternating torsional moment acting on an Oldham coupling in the scroll compressor. This moment cannot be balanced by shaft counterweights. This alternating moment can cause coupling chatter that in turn increases radiated sound, which is undesirable.

The purpose of this invention is to reduce coupling chatter by shifting the center of mass of the orbiting scroll. The orbiting scroll center of mass is shifted in such a way as to compensate for the torsional moment acting on the coupling.

The unwanted torsional moment can be a result of the center of mass of the orbiting scroll not being coincidental with its geometric center or due to variations in the generating radius of a scroll wrap profile. The scroll wrap profile, typical of refrigeration applications, will often have a generating radius that is not constant. This is a result of a wrap profile being represented by an involute other than an involute of a circle.

SUMMARY OF THE INVENTION

In disclosed embodiments of this invention, a scroll compressor is designed to minimize the alternating torsional moment acting on the coupling by adding or removing mass at selected locations on the orbiting scroll such that the orbiting scroll center of mass is at a desired location. The desired location may sometimes be at the geometric center of orbiting scroll for an involute of a circle wrap profile. Alternatively, the center of mass is sometimes offset from the geometric center to compensate for peculiarities of scroll wrap profile design, such as varying generating radius.

In a first embodiment, the shift in center of mass is achieved by removing mass from the base of the orbiting scroll through introduction of circular indentations that for example can be conveniently created by drilling or milling operation. The size and location of the indentations must be carefully selected to achieve proper center of mass location.

In another embodiment, mass is removed from a non-working portion of the outer flank of a scroll wrap. In yet another embodiment, mass can be removed from the outer periphery of the base of the scroll member.

In additional embodiments, mass could be added to any of the above locations, or other locations within the scroll member.

The basic invention is a method of designing an orbiting scroll member wherein the center of mass gravity is ideally located by adding or removing mass at selected locations.

The exact location and amount of mass removed or added would vary with the particular scroll compressor design and particular design goal. However, a worker of ordinary skill in the art would recognize how to optimize the required amount and location of orbiting scroll removed mass or added mass, based upon the teachings of this invention.

Further features of this invention can be best understood from the following specification and drawings, the following of which is a brief description.

DETAILED DESCRIPTION OF A PREFERRED EMBODIMENT

Figure 1:
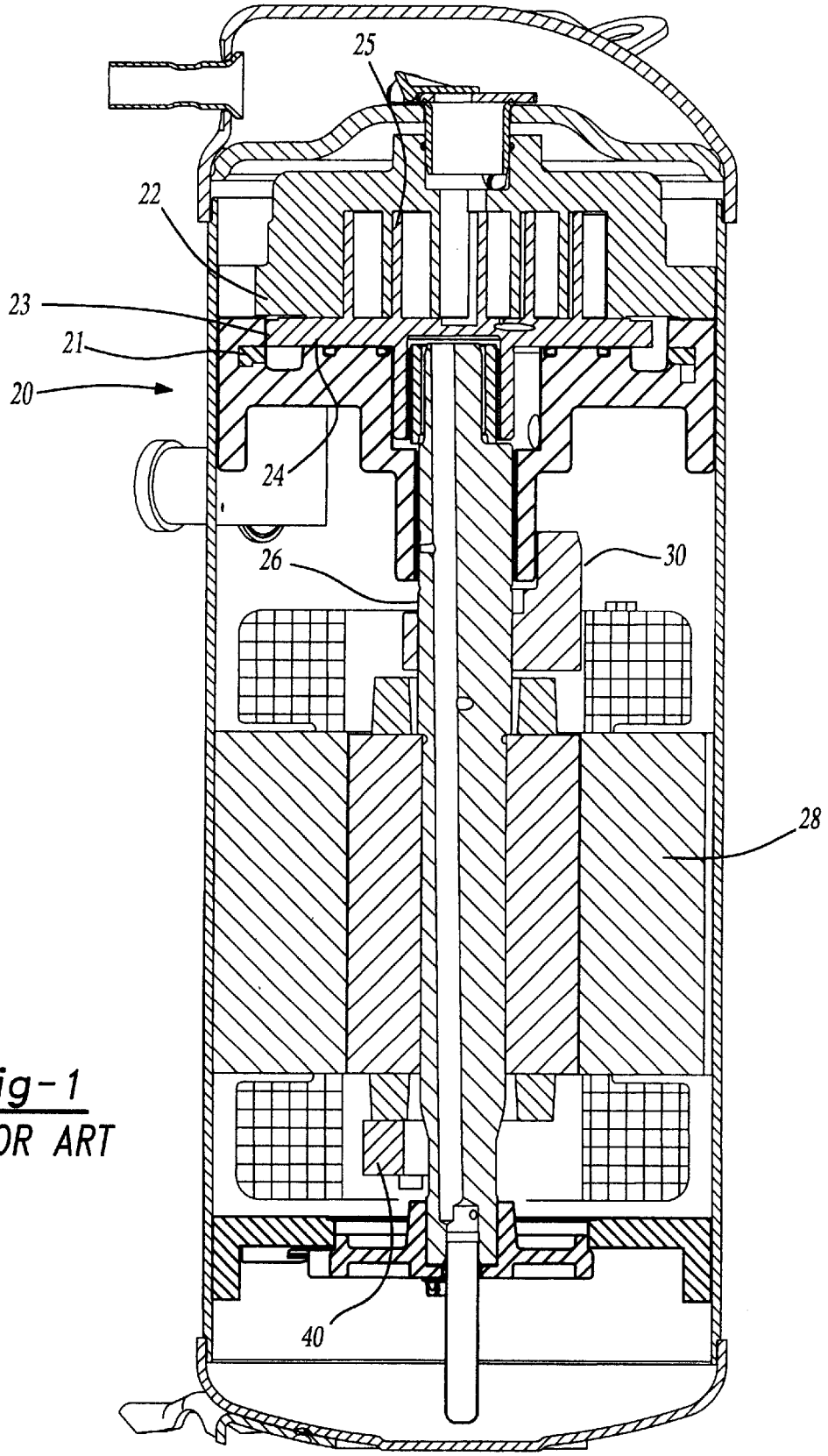
Fig-1 PRIOR ART
FIG. 1 shows a prior art scroll compressor.

FIG. 1 shows a scroll compressor 20 having a non-orbiting scroll 22 spaced from an orbiting scroll 23. Orbiting scroll 23 has a base plate 24 and a spiral wrap 25, as known. A shaft 26 is driven by a motor 28. As known, an Oldham coupling transfers a rotating motion of the shaft 26 into the orbiting motion of scroll 23.

Counterweights 30 and 40 are also illustrated. The counterweights 30 and 40 serve to balance forces and moments created by orbiting motion of the orbiting scroll. However, the counterweights are only effective in balancing the overall compressor vibration. The counterweights are ineffective in alleviating coupling chatter caused by alternating torsional moments acting on the Oldham coupling.

The present invention addresses this problem by shifting the center of mass of the orbiting scroll to minimize the alternating torsional moment. As an example, in the embodiment shown in FIG. 2A, the baseplate 24 has a plurality of indentations 29 drilled into the orbiting scroll baseplate. The location of the indentations is selected such that the overall effect is to shift the center of mass of the orbiting scroll 23 in the direction that will result in minimizing this torsional moment.

Figure 2A:
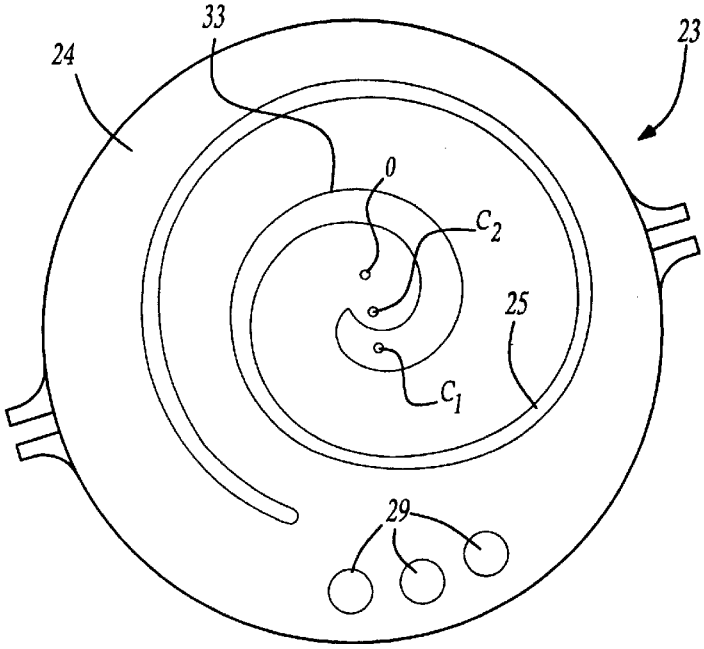
FIG. 2A shows a view of an orbiting scroll incorporating a first embodiment of the present invention with indentations placed on the orbiting scroll floor.
Figure 2B:
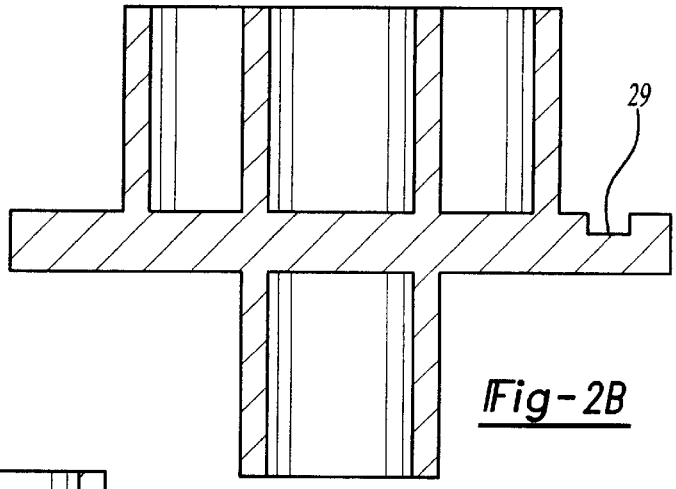
FIG. 2B shows a cross section view of an orbiting scroll of a first embodiment of the present invention.
Figure 2C:
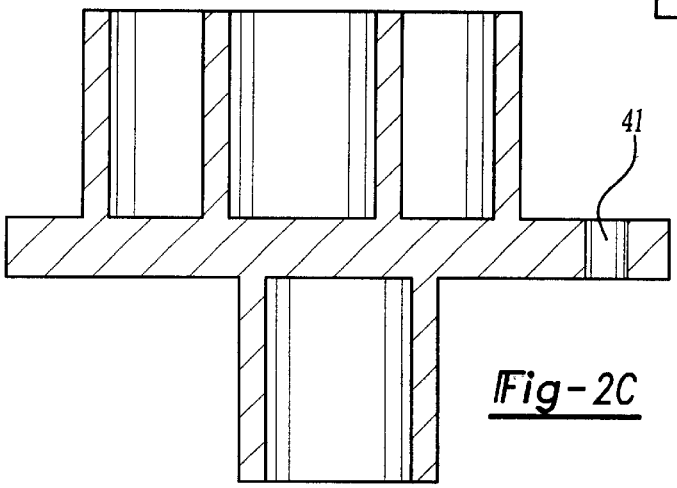
FIG. 2C shows a second embodiment of this invention where indentations penetrate through the baseplate of the orbiting scroll.

As shown in FIG. 2A, prior to material removal the center of mass of the orbiting scroll is located at position $C_1$. The present invention in the above embodiment places indentations 29 at such location on the orbiting scroll floor that the center of mass in this particular example, moved from Point $C_1$, to $C_2$ where, it roughly coincides with the geometric 0 center of the orbiting scroll. These indentations may be blind circular holes 29 located on the floor of the orbiting scroll as shown in FIG. 2A and FIG. 2C. The indentations 41 can also penetrate through the orbiting scroll baseplate as shown in the cross-sectional sketch in FIG. 2B. In all instances the indentations are preferably located not to interfere with the compression process or back chamber sealing.

Figure 3A:
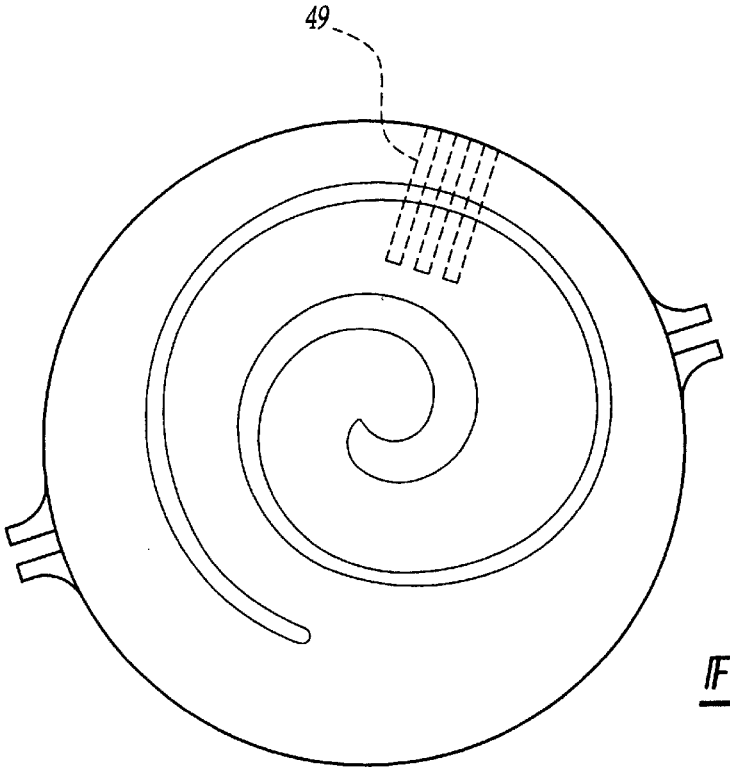
FIG. 3A shows a third embodiment of this invention where blind holes penetrate the orbiting scroll baseplate.
Figure 3B:
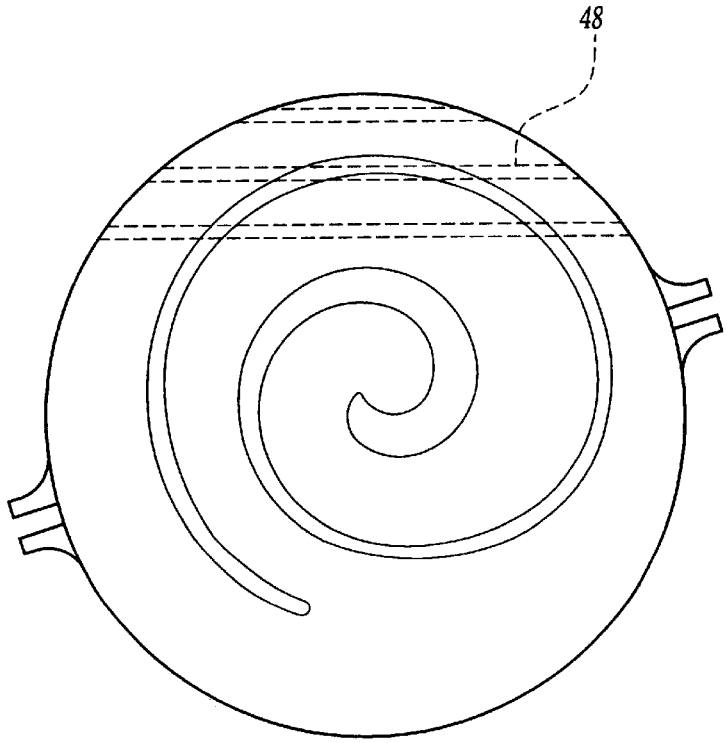
FIG. 3B shows a fourth embodiment of this invention where holes opening on both ends penetrate the orbiting scroll baseplate.

FIG. 3A and 3B show further embodiments, where the holes are drilled through the baseplate of the orbiting scroll in a direction generally perpendicular to the center axis of rotating shaft 26. Holes 48 can penetrate on both ends through the outer periphery of orbiting scroll baseplate as shown in FIG. 3B or can be blind holes 49 as shown in FIG. 3A. In both instances, holes are located between the floor and backface of the baseplate.

Figure 4:
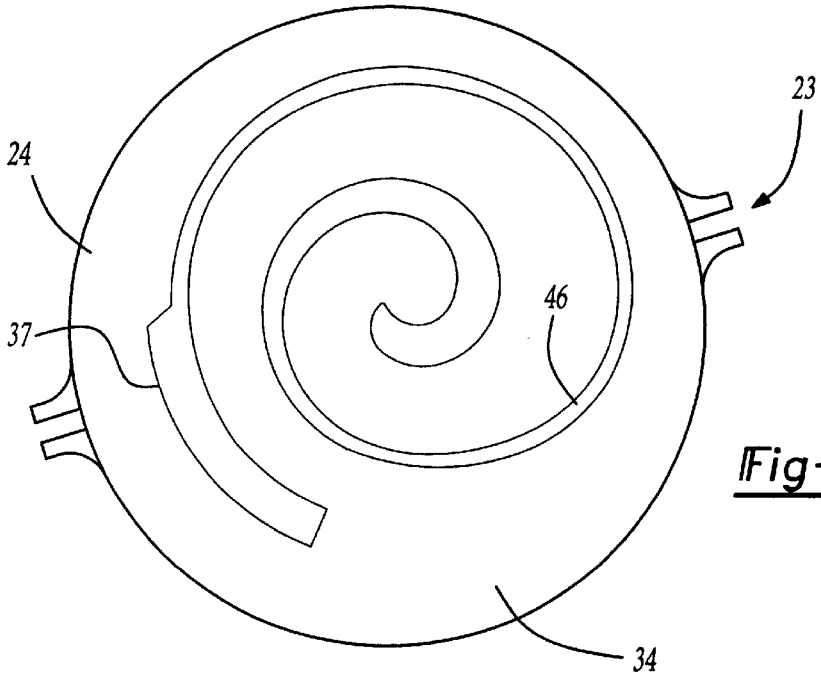
FIG. 4 shows a fifth embodiment of the present invention where mass is added to the orbiting scroll flank.

FIG. 4 shows another embodiment where the orbiting scroll wrap 46 has a mass 37 added to its flank to shift the center of mass of orbiting scroll in a desired direction.

Figure 5:
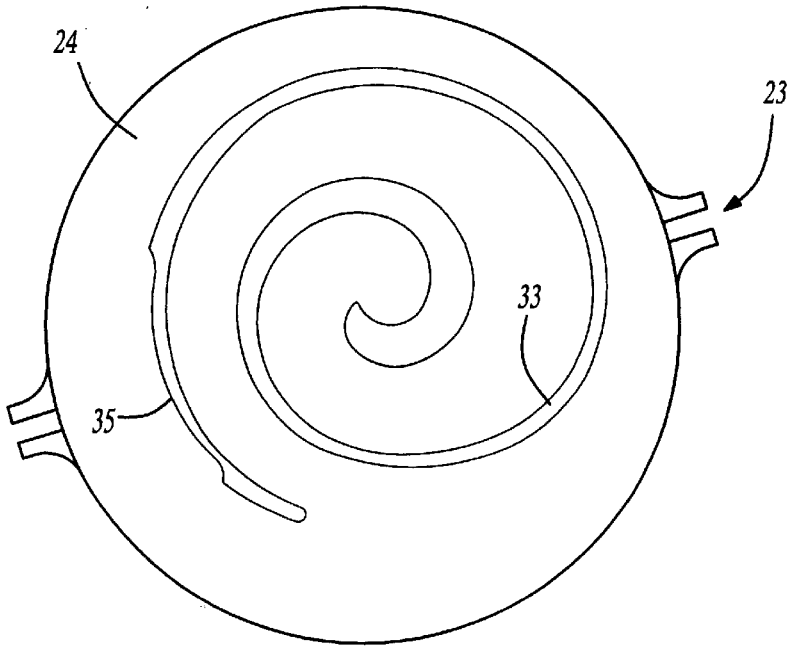
FIG. 5 shows a sixth embodiment of the present invention where mass is removed from scroll compressor flank.

FIG. 5 shows yet another embodiment wherein a scroll wrap 33 has a portion 35 of its outer flank removed to shift the center of mass of orbiting scroll in a desired direction.

The removal or addition of the mass to the flanks of the orbiting scroll is preferably accomplished in such a way that it does not compromise the compression process or causes interference with the fixed scroll.

Figure 6:
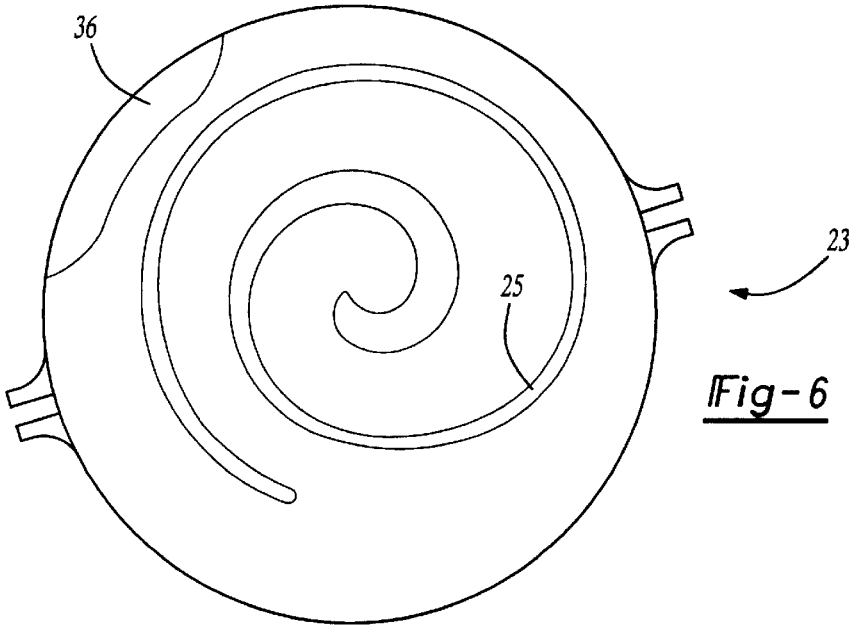
FIG. 6 shows a seventh embodiment of the present invention where mass is removed from the peripheral portion of the floor of the orbiting scroll baseplate.
Figure 7:
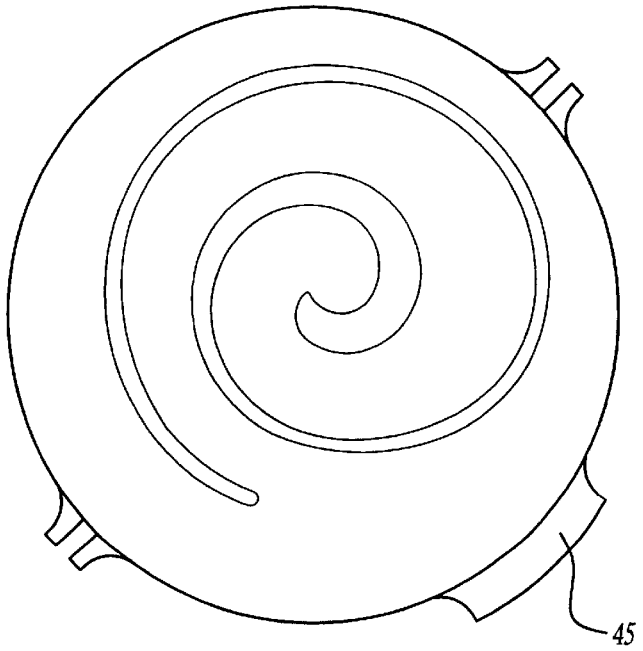
FIG. 7 shows an eighth embodiment of this invention where mass is added to the outer peripheral portion of the orbiting scroll.
Figure 8:
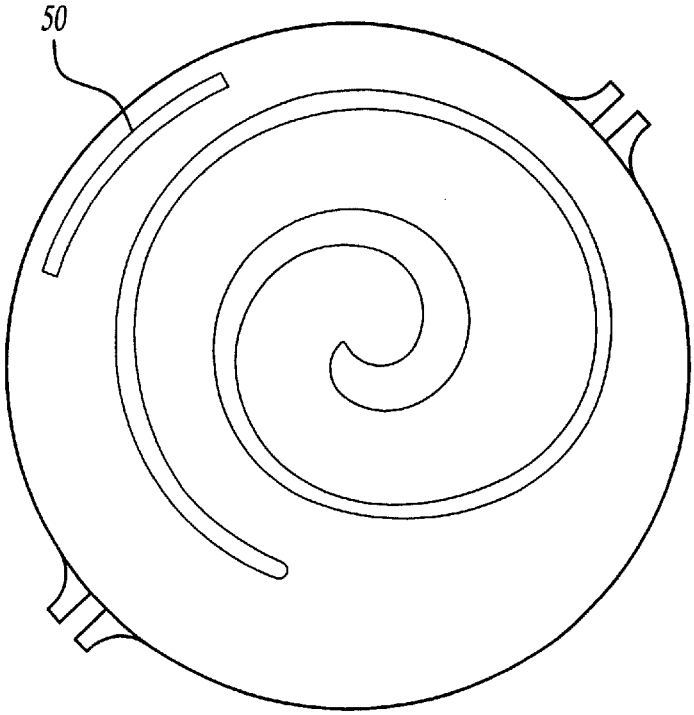
FIG. 8 shows a ninth embodiment of this invention where vertically extending mass is added to the orbiting scroll baseplate.
Figure 9:
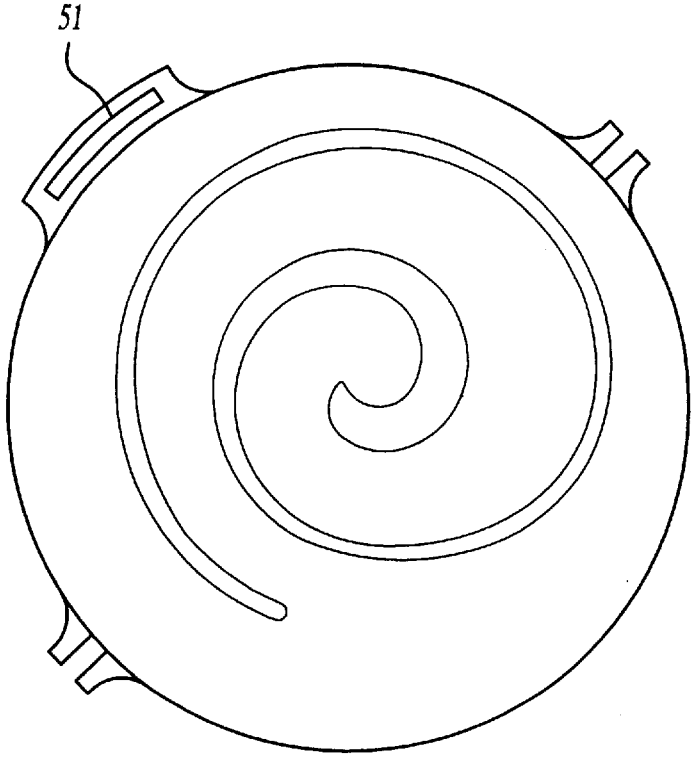
FIG. 9 shows a tenth embodiment of this invention where vertically extending mass is added to the orbiting scroll baseplate extension.

The peripheral portion 36 can be removed from the orbiting scroll floor as shown in FIG. 6. It should be understood that material can be removed from both the floor and backface of the orbiting scroll or an entire portion of the scroll peripheral section can be cut out. In a similar fashion material 45 can be added in a stepped down fashion to the outer peripheral portion of the orbiting baseplate extending radially outward as shown in FIG. 7. In another embodiments of this invention, the material 50 can be added to the outer portion of the orbiting scroll baseplate as extending vertically outward from said baseplate as shown in FIG. 8. The material 51 can also be extended vertically outward from the baseplate extension as shown in FIG. 9. The removal or addition of material to the outer peripheral portion of the orbiting scroll needs to be accomplished such that it does not compromise the compression process, back chamber sealing or results in interference with compressor shell, fixed scroll, coupling or crankcase.

In summary, the present invention shifts the center of mass of the orbiting scroll by adding or removing mass at strategic locations on the orbiting scroll to minimize Oldham coupling chatter. Once a particular scroll has been designed, the location and size of the removed or added mass can be easily determined. Also, a combination of removed and added mass can be utilized.

A worker of ordinary skill in the art would recognize that certain modifications would come within the scope of this invention. Thus, the following claims should be studied to determine the true scope and content of this invention.

What is claimed is:

1. A method of forming a scroll compressor comprising the steps of:

(1) designing an orbiting scroll having a base and a generally spiral wrap extending from said base, and identifying a desired center of mass for said orbiting scroll;

(2) designing a location and size of a plurality of removed areas in said base of said orbiting scroll to achieve said desired center of mass, and (3) forming said scroll compressor to include said plurality of removed areas, by removing said mass with penetrations through said base plate of said orbiting scroll.

2. A method as recited in claim 1, wherein said desired center of mass is chosen to approximate the geometrical center of said orbiting scroll.

3. A method of forming a scroll compressor comprising the steps of:

(1) designing an orbiting scroll having a base and a generally spiral wrap extending from said base, and identifying a desired center of mass for said orbiting scroll;

(2) designing a location and size of a plurality of removed areas in said base of said orbiting scroll to achieve said desired center of mass;

(3) forming said scroll compressor to include said plurality of removed areas; and (4) removing said mass from the floor of the orbiting scroll in a form of circular indentation.

* * * * *